United States Patent [19]

Annovi

[11] 4,387,517

[45] Jun. 14, 1983

[54] SKI BOOT WITH REMOVABLE FASTENING STRAPS

[75] Inventor: Giuseppe Annovi, Montebelluna, Italy

[73] Assignee: Dolomite S.p.A., Treviso, Italy

[21] Appl. No.: 233,562

[22] Filed: Feb. 11, 1981

[30] Foreign Application Priority Data

Feb. 21, 1980 [IT] Italy ..... 61913/80[U]

[51] Int. Cl.[3] ..... A43B 5/04; A43B 11/00; A43C 11/00

[52] U.S. Cl. ..... 36/117; 36/50; 24/71 SK

[58] Field of Search ..... 36/117, 118, 119, 120, 36/121, 50; 24/71 SK, 68 SK, 70 SK, 130

[56] References Cited

U.S. PATENT DOCUMENTS

| | | | |
|---|---|---|---|
| 4,150,500 | 4/1979 | Delery | 36/50 |
| 4,245,410 | 1/1981 | Molitor | 36/117 |
| 4,253,250 | 3/1981 | Weigl et al. | 36/50 |
| 4,310,951 | 1/1982 | Riedel | 36/50 |

*Primary Examiner*—Patrick D. Lawson
*Attorney, Agent, or Firm*—D. Paul Weaver

[57] ABSTRACT

Closing straps for a ski boot formed of plastics material have corresponding ends adjustably secured by pulling levers fixed on one flap of the boot upper. The ends of the straps remote from the pulling levers are releasably connected with projection elements on the other flap of the upper integrally formed with such flap from the same plastics material from which the upper is made by injection molding.

4 Claims, 5 Drawing Figures

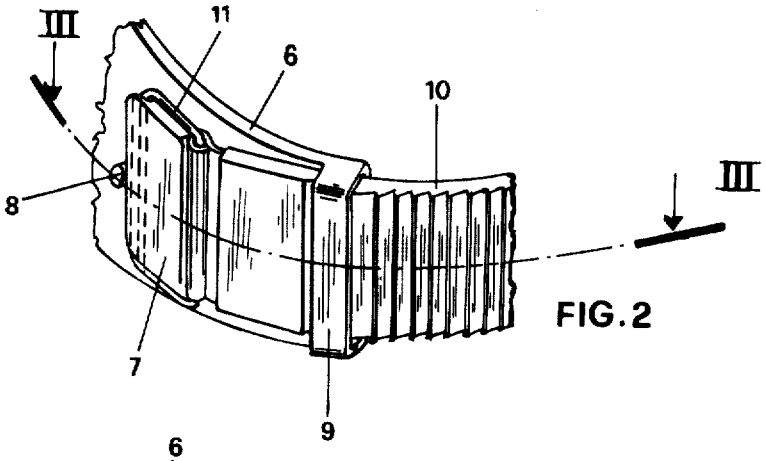
FIG. 2
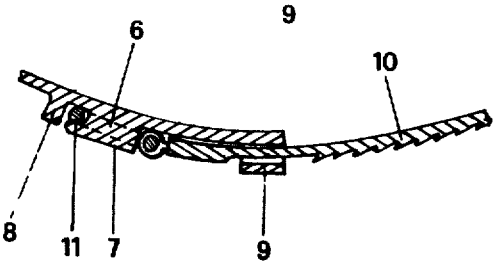
FIG. 3
FIG. 4
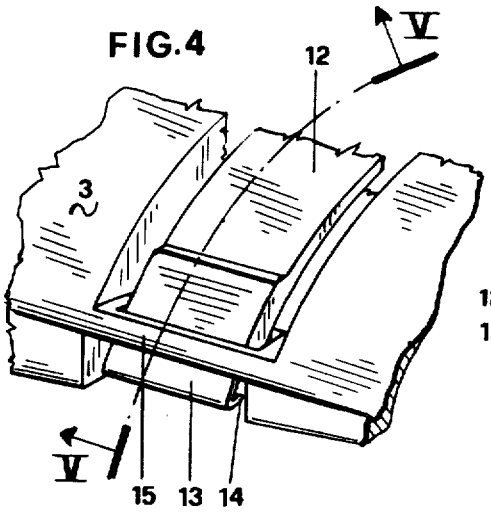
FIG. 5
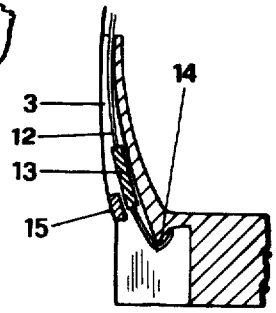

SKI BOOT WITH REMOVABLE FASTENING STRAPS

BACKGROUND OF THE INVENTION

The invention relates to completely removable closing straps for ski boots of the type made from injection molded plastics.

Molded plastics boots are known having closing straps integrally attached to one flap of the upper, and cooperating with a lever device fixed on the other flap of the upper. If the straps of such boot are accidentally broken, the entire boot becomes useless. A further disadvantage is that the closing strength adjustment is not constant and gradually changes as the boot ages, unless the straps are indentured. This, in turn, significantly increases the cost of the mold for making the boot in a single injection molding operation.

In another known type of ski boot, plastic closing straps separately manufactured are fastened to the boot upper by pegs, rivets or the like. While this allows satisfactory adjustment of closing tension, a drawback of the arrangement is that the mounting of the straps requires extra manufacturing steps which increases the cost of the product. Moreover, while these closing straps are replaceable in the case of failure, their replacement requires special tools and can usually only be carried out in a specialized workshop, resulting in inconvenience to the skier.

SUMMARY OF THE INVENTION

In accordance with this invention, the above drawbacks of the prior art are all overcome in a ski boot formed of plastics material, through the provision of closing straps having corresponding ends adjustably and releasably secured to one flap of the upper by the cooperation of strap pulling levers fixed on that flap of the upper. The other ends of the closing straps away from the levers are provided with separable attaching elements adapted for engagement with projection elements on the other flap of the upper made of the same plastics material of the upper during the injection molding operation.

Advantageously, the last-named ends of the straps may be provided with rings cooperating with corresponding projections integrally molded on the upper. Each projection can be mushroom-shaped, and can be in cooperative relationship with an adjacent stem rising from the flap of the upper and spaced from the margin of the projection, by a distance slightly less than the thickness of the ring carried by the strap.

Further in accordance with the invention, a strap extending across the front portion of the boot can have a hook-like end cooperating with a molded boss protruding from the upper at the hollow of the foot.

The flap of the upper can also be provided close to the connecting element of each strap with a loop for the strap, such loop being integral with the upper.

BRIEF DESCRIPTION OF THE DRAWINGS

FIG. 2 is an enlarged fragmentary perspective view of the area A enclosed by the phantom line in FIG. 1.

FIG. 3 is a horizontal section taken on line III—III of FIG. 2.

FIG. 4 is an enlarged fragmentary perspective view of the area B within the phantom line shown in FIG. 1.

FIG. 5 is a vertical section taken on line V—V of FIG. 4.

DETAILED DESCRIPTION

Figure 1:
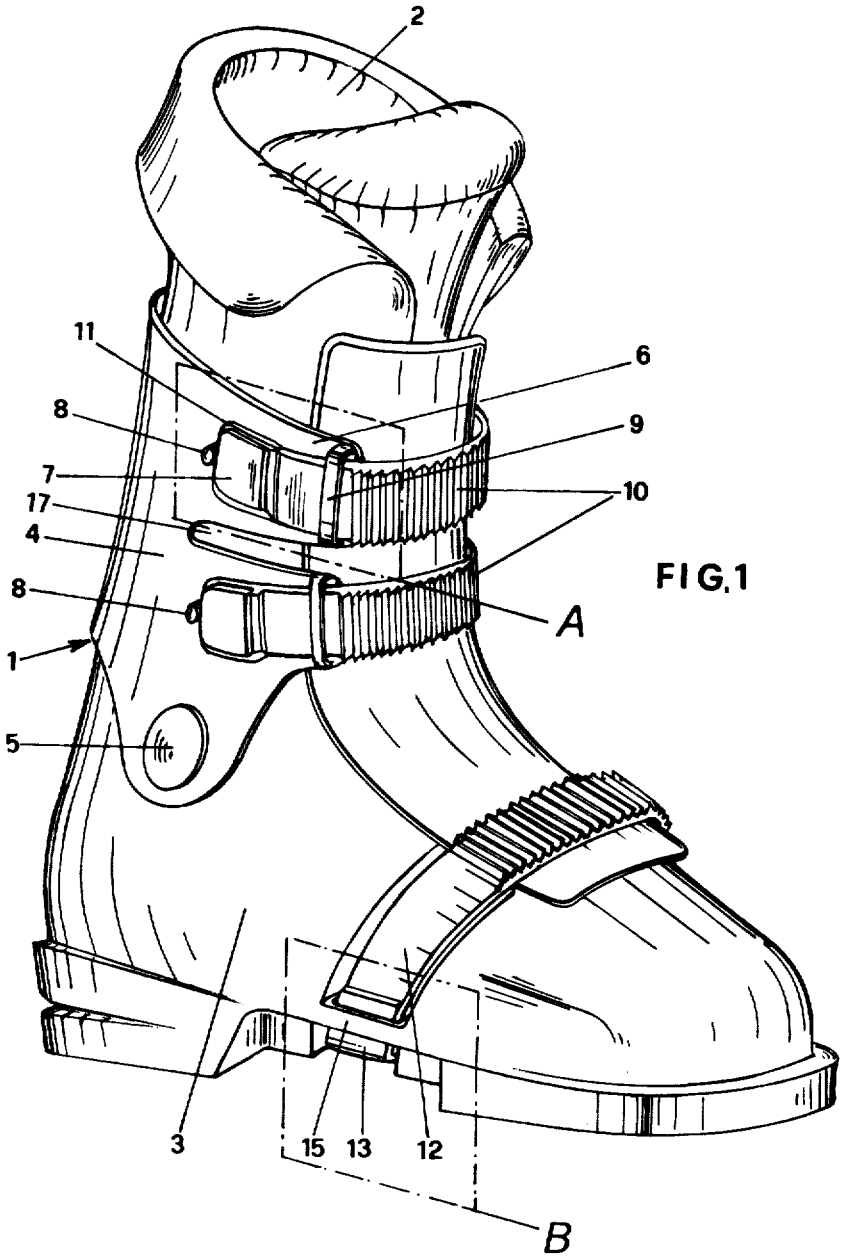
FIG. 1 is a perspective view of a ski boot according to the invention.

Referring to the drawings in detail, a ski boot, FIG. 1, formed of plastics material is manufactured conventionally by injection molding. The boot comprises a substantially rigid upper 1 and a soft inshoe 2. The upper includes a boat 3 and a collar 4 connected to the boat through articulation elements 5 located adjacent to the skier's ankle.

The collar 4 of the upper is forwardly divided to form two flaps 6 separated by an elongated opening 17. On each flap 6 of the upper, there is provided an integral projection 7 closely adjacent to a thin stem 8 and toward its forward end an integral strap loop 9 is also provided on the flap 6. The elements 7, 8 and 9 are formed of the same plastics material as the collar 4 during the injection molding of the latter.

The closing means for the collar further comprises a pair of plastics material straps 10, separately manufactured and indentured to provide for adjustment of the tension of the closure by means of a pulling lever, not shown, fixed on the collar flap 6 away from the flap shown in FIG. 1. The end of each strap 10 shown in FIG. 1 and remote from the pulling lever carries a ring 11, detachably connected to the corresponding projection 7 which is mushroom-like in shape, FIG. 3. The stability of the ring 11 with respect to the projection 7, and therefore of the strap 10 relative to the collar 4, is enhanced by the presence of the stem 8 which is spaced from the margin of the projection 7 by a distance slightly less than the thickness of the ring 11, FIG. 3.

The closing means of the boat 3 includes another strap 12 substantially identical to straps 10 and having a hook 13 at its end away from the pulling lever, not shown. By means of this hook 13, the end of strap 12 cooperates with an integral boss 14 formed on the upper at the hollow of the foot. As in the case of the strap 10, the strap 12 is not allowed to separate from the boss 14 when the closure is opened, owing to the presence of a loop 15, formed, like the boss 14, from the same plastics material from which the boat 3 is made.

The ski boot thus manufactured presents a number of advantages over both the conventional boots having straps integral with the upper, and conventional boots having separately manufactured straps riveted in place.

With respect to the first type, the invention allows the replacement of straps accidentally broken during use and also allows a much simpler mold for the upper. With respect to the second class of boots, the invention allows the elimination of riveting of the straps to the boot, and the skier himself without special tools can replace the broken straps.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A ski boot formed of plastics material and including an upper having flaps, one flap of the upper having integral mushroom-like projecting elements formed of the same plastics material from which the upper is made by injection molding, closing straps for the upper adapted to be tightened by pulling levers fixed on the flap remote from the projecting elements, a ring on the end of each of said straps adapted to interlock with one of said projecting elements, and stems rising from said one flap and spaced from the margin of said projecting elements by a distance slightly less than the thickness of said ring, whereby when the straps are broken they may be easily replaced by new straps.

2. A ski boot as defined in claim 1 wherein said straps are indentured to provide for adjustment of the tension of the straps in cooperation with said pulling levers.

3. A ski boot as defined in claim 1, and another strap crossing the forward portion of the boot and having a hook-like end engageable with an integral boss protruding from the upper at the hollow of the foot.

4. A ski boot as defined in claim 1, wherein the flap of the upper carrying the projecting elements also carries strap receiving loops integral with the upper in closely spaced relationship to the projecting elements.

* * * * *